United States Patent [19]

Berger

[11] Patent Number: 4,645,204

[45] Date of Patent: Feb. 24, 1987

[54] COMPACT PORTABLE EXERCISING APPARATUS

[76] Inventor: Isaac Berger, 1501 Broadway, New York, N.Y. 10036

[21] Appl. No.: 698,680

[22] Filed: Feb. 6, 1985

[51] Int. Cl.[4] ..... A63B 21/02

[52] U.S. Cl. ..... 272/137; 272/142

[58] Field of Search ..... 272/135–143, 272/900

[56] References Cited

U.S. PATENT DOCUMENTS

| | | | |
|---|---|---|---|
| 134,527 | 1/1873 | Eastman | 272/142 |
| 741,966 | 10/1903 | Hernsheim | 272/142 |
| 3,561,758 | 2/1971 | Huber | 272/138 |
| 3,687,450 | 8/1972 | Schollmeyer | 272/137 |
| 3,764,132 | 10/1973 | Hepburn | 272/140 |
| 4,059,265 | 11/1977 | Wieder et al. | 272/137 |
| 4,463,948 | 8/1984 | Mohr | 272/136 |
| 4,521,013 | 6/1985 | Dofel | 272/142 X |

*Primary Examiner*—Richard J. Apley
*Assistant Examiner*—Robert W. Bahr
*Attorney, Agent, or Firm*—Kirschstein, Kirschstein, Ottinger & Israel

[57] ABSTRACT

An exercising apparatus constituting an oblong housing having handles at opposite ends that are interconnected by a shock cord which extends through the housing being looped internally of the housing by passage back and forth between sheaves adjacent opposite ends of the housing so that the length of the cord between the handles in idle condition of the apparatus is several times the distance between the handles in the latter's idle position whereby a greater length of shock cord is available for stretching from idle condition than would be available if the shock cord directly connected the handles without such looping.

5 Claims, 5 Drawing Figures

COMPACT PORTABLE EXERCISING APPARATUS

BACKGROUND OF THE INVENTION

1. Field of the Invention

The present invention generally relates to a particularly compact exercising device designed to be anchored either by or on the exerciser's body.

2. Description of the Prior Art

The art of exercising equipment is an extremely crowded one, to which the present inventor has contributed his share. However, generally speaking, almost all exercising apparatuses, except those consisting solely of liftable weights designed to be grasped by the hands, generally are bulky, relatively complex in design, not adapted to be readily carried about, not light in weight, particularly on a weight-per-pound-of-resistance ratio, are composed of many parts, and are quite costly, particularly for the average pocketbook. Exemplificative of such designs as shown in the patented art are the following U.S. Pat. Nos. 2,397,054; 3,471,145; 3,937,461; 4,195,835; 4,290,599 and 4,391,440. Of the foregoing U.S. Pat. Nos. 3,471,145 and 4,290,599 are only relevant in that they show portable exercising devices, but their portability is somewhat questionable in that they have one rather long dimension which would make them difficult to pack in a small suitcase.

The remaining four patents, namely, U.S. Pat. Nos. 2,397,054; 3,937,461; 4,195,835 and 4,391,440, are more relevant to the invention which forms the subject matter of the present application in that they disclose exercising devices, including strings as the elements which connect the hand-grippable elements with resistance elements for exercising purposes. But these devices include mechanical components having at least one long dimension which make the devices impractical to pack in a small suitcase.

Specifically, U.S. Pat. No. 2,397,054 discloses an exercising apparatus in which there is a large base totally incapable of being enclosed in a small suitcase, the base being provided with guideways in which trolleys ride. The trolleys are attached to coil springs that, in turn, are attached to cables which run to handles. The user operates the apparatus much like a rowing machine. Considerable space is required to pack the apparatus for transport or for storage, and the apparatus is only capable of being used in the performance of a few rather simple exercising maneuvers.

U.S. Pat. No. 3,937,461 discloses an exerciser for aerial calisthenics. It is the type of apparatus designed to be attached to a tyro during instruction in calisthenics, and includes a harness attached to strings led through a series of pulleys to hand grips which enable a trainer or trainers to manipulate the tyro during the performance of aerial exercises being learned. Even if used solely for exercising rather than for training, this equipment is cumbersome and could not be packed in a small space for transport or storage.

U.S. Pat. No. 4,195,835 discloses a cable exercising apparatus which includes a pair of treads connected by forks to opposite ends of an elastic cable, the intermediate portion of which is received in a groove formed at the top of a bar designed to be held at about crotch level when the cable is relaxed. The bar is necessarily quite long and would prevent this apparatus from being packed in a small suitcase for storage or transport. The device of this patent is useful only for one form of exercise, namely, vertical lifting from crotch to shoulder or fully-upstretched hands.

SUMMARY OF THE INVENTION

1. Objects of the Invention

It is an object of the invention to provide an exercising apparatus and methods of exercising which avoid the disadvantages of prior art exercising devices.

It is another object of the invention to provide an exercising apparatus which is not only lightweight and portable, but is sufficiently compact to fit into a small size suitcase; by small size is meant approximately $7'' \times 15'' \times 5''$.

It is another object of the invention to provide an exercising apparatus which can be held in position, in at least one mode of use, by the user's own body weight.

It is another object of the invention to provide an exercising apparatus which can be used by placement of a major component thereof on the chest or abdomen or back of a user during an exercising procedure.

It is another object of the invention to provide an exercising apparatus which, despite its small size, and the fact that it employs an elastic cable instead of a spring, enables a user to move his or her hands or feet a sufficient distance to perform true exercising movements.

It is another object of the invention to provide an exercising apparatus which enables a user to move his or her arms in various different directions for exercising.

It is another object of the invention to provide an exercising apparatus which is capable of versatile functions, but which yet is so compact and light that it can be carried about in an attache case so that a normally sedentary person can carry it about inconspicuously to perform calisthenics at convenient times.

It is another object of the invention to provide an exercising apparatus which constitutes relatively few and simple parts, is inexpensive to manufacture, easy to use and can be sold at a low price.

2. Features of the Invention

In keeping with the foregoing objects and those which will become apparent as this description proceeds, a feature of the invention resides, briefly stated, in the provision of a casing which does not exceed in dimension at its largest face a size of $6\frac{1}{4}'' \times 14''$ and is no more than 1" in depth. The casing, pursuant to the invention, is hollow and is made of any self-form-maintaining material, metal or plastic being exemplificative. Optionally, both ends of the casing are closed, but are provided with openings to pass an elastic cable, there being either one or two elastic cables, preferably two.

Furthermore, the apparatus includes two handles or grips, and the cables connect these two grips and run through the casing. The special novelty of the invention resides in the configuration of the cable or cables within the casing. At this point of their location, the cables are folded, the folds being contained within the casing so that, in effect, any portion of the cable or cables extending from a handle into the casing and either back to the handle, or to the other handle, or through the casing to the other handle and back to the first handle, experiences a folding of its length at that portion thereof which is within the casing. In effect, therefore, the cable is overly long, and the overly long portion thereof which one might refer to as slack, although it is not really loose, is taken up by the folding.

The apparatus also includes, internally of the casing, means to maintain the folded portion in such folded condition. One such means, and a preferred one, is in the form of pulleys disposed within the casing in spaced-apart relationship in the direction between the handles. Thus, a given cable will, for example, enter the casing at one side of the casing, be trained around a pulley at the side of the casing remote from its point of entry, then be trained around the pulley at the near side of its point of entry, etc. This length of cable eventually may terminate at the opposite handle or terminate at the same handle, depending upon the particular configuration employed. When the user pulls the handles apart, the cable or cables elongate, i.e. stretch, to a greater length, so that the portions of the cables externally of the casing become physically and visibly longer, as contrasted to the relaxed position of the apparatus in which the portions of the cable or cables externally of the casing are much smaller and, indeed, sometimes extremely small. In the form of the invention shown herein, only a single cable is employed which is trained, in sequence, through one handle, then back and forth through the series of interior pulleys, then through the other handle, then back and forth through another series of interior pulleys, then back to the first handle.

With this arrangement, the exercising apparatus, when in relaxed condition, occupies a space which is only very little larger than the casing itself and yet is capable, during an exercising operation, of having the handles expanded to substantial distances apart, sufficient to accomplish any desired exercising procedure. The casing can be used in various manners. For example, it can serve as a platform for the feet, in which event, the handles can be pulled up from the floor by the exerciser's hands; or the casing can be placed on the exerciser's chest, in which case, the exerciser, after gripping the handles, can swing his or her hands outwardly and forwardly, or upwardly, or downwardly, or in a seesaw motion; or the casing can be placed on the user's back between the shoulders and a somewhat similar series of exercises performed with the hands, so that the exercising apparatus of the present invention can function in a pluralistic mode of operations, despite its simplicity, small size and low cost.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENT

Figure 1:
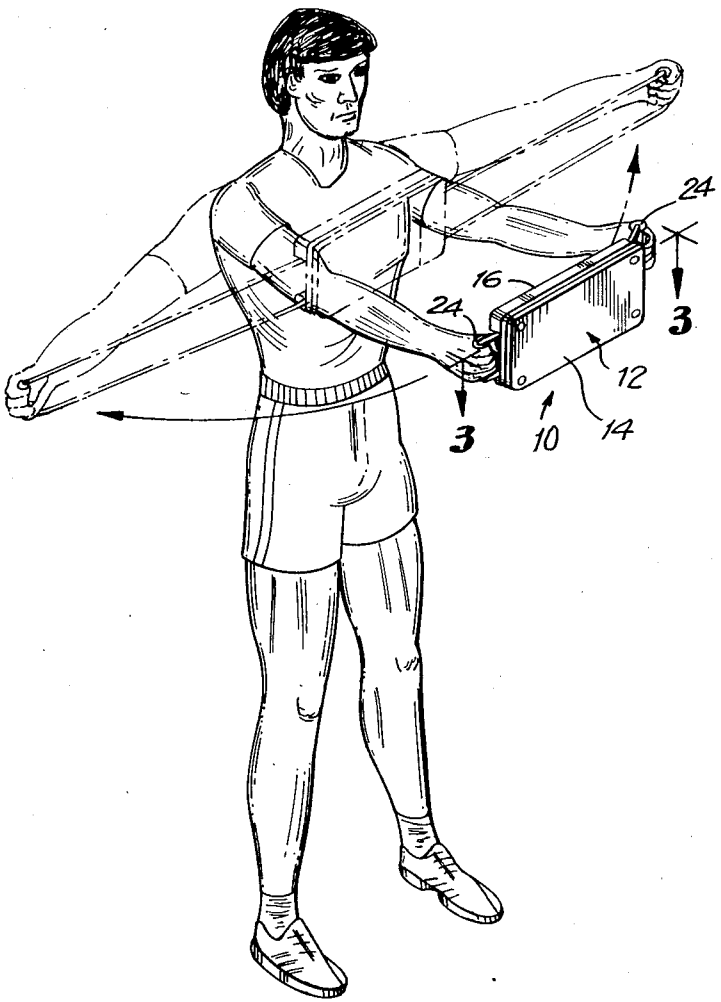
FIG. 1 is a perspective view of the exercising apparatus of the present invention in the process of use by an exerciser, with arms extended forwardly and holding the exercising apparatus, and feet slightly spread apart, and showing, in dotted lines, movement of the arms to outstretched horizontal position while holding the handles of the exercising apparatus.
Figure 4:
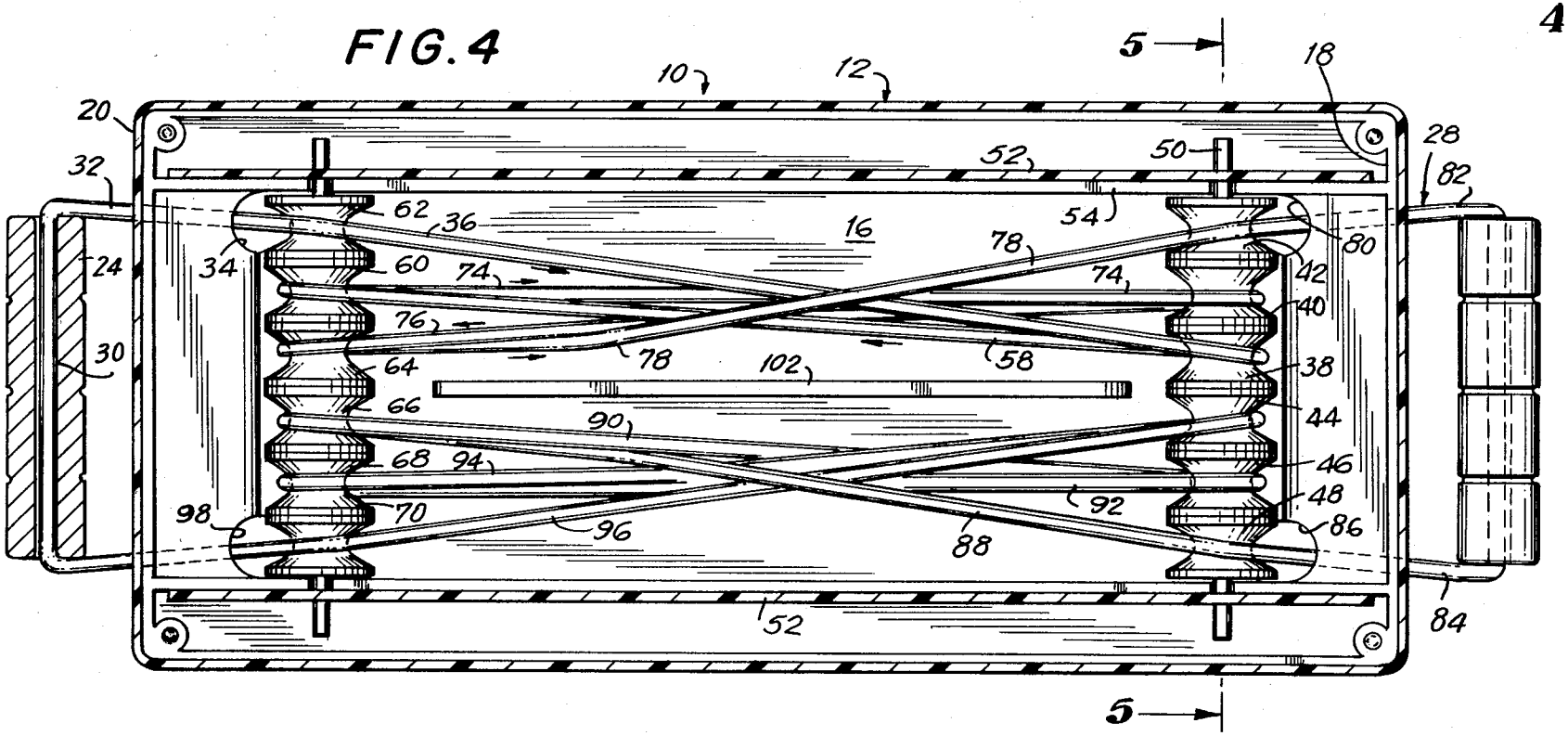
FIG. 4 is a sectional view taken substantially along the line 4—4 of FIG. 3.

Referring now in detail to the drawings, the exercising apparatus of the present invention is denoted by the reference numeral 10. The same comprises a hollow housing 12 desirably formed of two component halves, namely, a half 14 which conveniently will be denominated a bottom half simply for ease of reference, and a top half 16. The two halves are interengageable to provide a hollow enclosure. Preferably, the housing is elongated, and an optional form is oblong, as best seen in FIGS. 1 and 4. It will be appreciated that this is but one of many forms to which the housing may be shaped without interfering with its desired functions. Desirably, also, the ends of the housing, these being the sides of the housing which are of the lesser dimension, are straight and parallel to each other.

In order to minimize the weight of the exercising apparatus 10, the housing, in a preferred form of said apparatus, is fabricated from plastic material, e.g. an ABS plastic which is rigid and strong and capable of withstanding reasonable amounts of stress as when an adult stands on it. It will be understood, of course, that the invention is not restricted to the use of this material, and that it embraces the use of other materials, for example, sheet steel, particularly if the exercising apparatus is to be employed in the home or in a gymnasium and is not in its ordinary utilization to be extensively carried about away from its place of use.

The two halves are designed to be detachably coupled and, to this end, the mouth 18 of the top half is shaped and dimensioned to be snugly received within the mouth 20 of the bottom half. In a preferred form of the invention, the detachable engagement between the two halves is a tight frictional engagement because the exercising apparatus 10 is intended to be marketed ready for use, and it is not envisioned that the housing be opened to gain access to its interior once the housing has been closed. Thus, in a form of the invention, the connection between the two halves of the housing is envisioned as being a permanent one and, to this end, the two halves may be joined, in addition to a tight frictional fit, by the interposition of a cementitious bond, or by sonic welding, or by heat-and-pressure welding, or by tackifying each or both surfaces of the mouths of the two halves which come into contact with each other so that an autogenous bond will be formed between them. It will be understood, of course, that the specific nature of the joint between the two halves is not a critical aspect of the present invention and only is a subordinate feature thereof. In some forms of the invention, for example, where the exercising apparatus is designed for commercial use as in a gymnasium, it may be desirable to have the connection between the two halves detachable so that the two halves can be taken apart and the housing opened for replacement or repair of one or more of the internal parts subsequently to be described.

The male portion of the two telescoping halves, in this instance the top half, may include means to limit insertion of its mouth into the mouth of the other half, such means constituting, as illustrated, a rib 22 circumscribing the side wall of the top half a short distance away from the rim of the mouth, and designed to be abutted by the rim of the mouth of the bottom half to define the fully coupled position of the two halves.

The exercising apparatus 10 further includes hand-engaging means of any suitable form, a different one for each of a user's two different hands. The two hand-engaging means may assume any of various possible configurations or forms and one appropriate shape and construction is illustrated in the accompanying figures, namely a hand-grip or handle 24, there being two of these, one for each of a user's hands, i.e. one for the right hand and one for the left hand of the user. In keeping with the desire to maintain the exercising apparatus light in weight, where such a feature is of interest, the handles may be made of plastic, although wood, too, is acceptable. The handles are of generally cylindrical form and are provided with a longitudinal bore for a purpose which soon will be apparent. As later will be seen, the handles in idle state of the exercising apparatus preferably are contained close to or within the confines of the outline of the housing. Accordingly, in the form of exercising apparatus shown in the accompanying figures, the narrow ends of the casing, these being the ends perpendicular to the long sides of the housing, are formed to provide inset shelves or niches 26, these being provided in the end walls of the top half 12. Each niche is of a height and depth approximately enough to accommodate the diameter of a handle 24 so that the handles can be placed in the two niches when the apparatus is not in use.

The two handles are substantially mutually parallel and are effectively interconnected by a resiliently extensible means so that the handles can be pulled apart under tension to provide calisthenic exercise for a user. Suitable such exercises shall be described later. It is well known in the exercising art to provide exercising equipment including a pair of handles interconnected by resiliently extensible means for calisthenic purposes. Typically, such exercisers include two frames, each including a handle to be grasped by a user and plural elastic strands or strings having their ends connected to the two frames so that the elastic strands or strings, usually in parallel, can be stretched by moving the handles apart. However, in such previous exercising devices, there was always a compromise that had to be arrived at. As a rule, a given type of resiliently extensible means only could be stretched by a certain percentage. It had a limit to the percentage it could be stretched. When this limit was reached, it could not be stretched further without breaking it. If a user wanted to move the two handles apart by a certain amount, the user had to employ springs or elastic strands which were a minimum certain percentage of such amount when idle. There was a somewhat similar problem with the amount of force that a user could be required to exercise when performing a particular calisthenic. This, too, was restricted by the length of the strings or springs that were provided. Pursuant to the present invention, however, this restriction is overcome in an unusual way. It is done by including, within the interior of the housing, a means for linearly amplifying the length of the resiliently extensible means which effectively interconnects the two handles so that although the resiliently extensible means utilized in any specific exercising apparatus embodying the present invention may be of a certain length, the distance separating the two handles when in idle position of said apparatus, is but a fraction of that length, usually a small fraction of that length.

In a particular form of the invention illustrated and now to be described, only a single resiliently extensible means is employed, this being the preferred form. However, it will be appreciated that two resiliently extensible means may be utilized and, indeed, if desired, several such means can be employed, the basic idea generally being that in this illustrated and preferred form of the invention, the resiliently extensible means, after running a short distance from each handle, enters into the interior of the housing at one end thereof, passes through the interior of the housing to the other end and exits from the interior for connection to the other handle after passing a short distance externally of the housing. The unique feature of this invention resides in the looping path, actually paths, followed by the resiliently extensible means within the interior of the housing. More particularly, the resiliently extensible means, after entering the housing at any given end, hereinafter the proximal end of the housing, extends to a retroverting means, preferably a relatively easy-turning retroverting means such as a sheave near the far end of the housing, hereinafter the distal end of the housing. The resiliently extensible means then turns 180° and passes back to the proximal end of the housing where it turns about another retroverting means and then passes back to the distal end of the housing, etc. As many passes as are desired are made depending upon the multiplying factor desired until finally the resiliently extensible means exits from the distal end of the housing to enter the handle at that end. Thereafter, the resiliently extensible means passes through the handle and re-enters the distal end of the housing, once again looping back and forth the same number of times it did in the first series of passes from the proximal end to the distal end and eventually exits from the proximal end and is connected to resiliently extensible means after passing through the handle at the proximal end until the resiliently extensible means now is a continuous band. The foregoing is an abbreviated description of a construction of the principal feature of the present invention.

Figure 3:
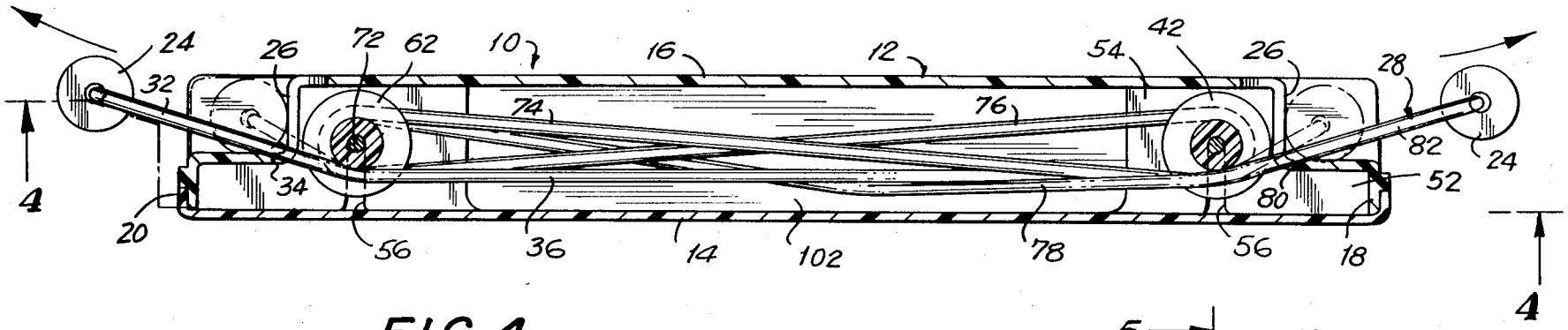
FIG. 3 is an enlarged sectional view of the exercising apparatus taken substantially along the line 3—3 of FIG. 1; in this view, the handles are shown in solid lines in partially extended position, and in dot-and-dash lines in fully retracted, i.e. idle, position.

Reverting now to the detail illustrated in the drawings, the resiliently extensible means is denoted, in general, by the reference numeral 28. The segment of the resiliently extensible means which passes through the handle 24 at the left hand side of the apparatus 10, as seen in FIG. 3 and shown in dot-and-dash lines in idle position in this figure, is indicated by the reference numeral 30. The segment of said resiliently extensible means at the proximal end between the handles and exterior of the housing, is indicated by the reference numeral 32. The resiliently extensible means enters the housing through an opening 34 in the housing at the proximal end and the reference numeral 36 denotes the segment extending from the opening 34 toward the distal end of the housing. This segment is trained about a sheave 38. There are six sheaves 38, 40, 42, 44, 46, 48 at the distal end of the housing, said sheaves as indicated earlier are made of a desirable light-weight material such as plastic, e.g. an ABS plastic. All the sheaves may be identical in configuration and dimension and all are rotatably journaled in an abutting side-by-side relationhip at each end of the housing on a steel rod 50. Each rod is supported at its ends on upstanding flanges 52 molded in one piece with the lower wall of the bottom half 14. The upper edges of these flanges are formed with semi-circular recesses in which the rods are received near their ends to prevent transverse movement. Vertical movement of the rods is prevented by their reception in downwardly extending flanges 54 integrally molded with the wall of the top half 16 and provided with slots 56 to receive the ends of the rods. Axial movement of the rods is restrained by their lengths which are long enough to cause their tips to strike the insides of the long walls of the top half 16 before leaving either of the flanges 52. The stack of sheaves 38, 40, 42, 44, 46, 48 at the distal end of the housing 12, fit nicely between the flanges 54 so that there is no undue axial shifting thereof.

The segment 36 of the resiliently extensible means after having been trained about the sheave 38 is directed back toward the proximal end of the casing as a segment 58 where it reaches a sheave 60 which is one of six sheaves 60, 62, 64, 66, 68, 70 rotatable on a steel rod 72 in a fashion similar to the rod 50. The segment 58, after being retroverted about the sheave 60, passes back towards the distal end of the exercising apparatus as a segment 74 and reaches at such distal end the sheave 40 about which it is trained to be retroverted and passed back toward the proximal end of the exercising apparatus as a segment 76. The segment 76 is trained about the sheave 64 which retroverts it to a segment 78 which is directed back to the sheave 42 at the distal end of the exercising apparatus. From the distal end of the apparatus, the segment 78 passes through an opening 80 to the exterior of the apparatus leaving the opening as a segment 82, external to the apparatus at said distal end and being connected to the handle 24 at such distal end by passing through the bore of said handle. It is to be noted that the segment 32 after entering the exercising apparatus upon passing through the opening 34 at the proximal end thereof, is guided over the sheave 62 at such proximal end before extending as segment 36 toward the sheave 38. Both sheaves 42 and 62 are not retroverting sheaves, they are simply guiding sheaves to prevent chaffing, rubbing or fraying of the resiliently extensible means.

A typical resiliently extensible means is a strand of single core rubber or synthetic elastomeric plastic or a multiple twisted core rubber or synthetic elastomeric plastic overlaid by a stretchable covering braid such as conventionally is employed in exercising equipment. Alternatively, the resiliently extensible means may constitute a coil spring which may or may not be covered. The form of the invention including a single core or multiple core rubber or synthetic elastomer is presently preferred, e.g. shock cord.

The balance of the connection of the resiliently extensible means is clearly illustrated in FIG. 4, but for the sake of completeness now will be briefly described.

After passing through the distal handle 24, the said means leaves the handle by a segment 84 and passes through an opening 86 in the distal end of the casing and is guided over the sheave 48 to a segment 88 that leads to the sheave 66. After retroverting about the sheave 66, the resiliently extensible means leaves by a segment 90 to reach the sheave 46 about which it is retroverted to form a segment 92 that leads to the sheave 68. The segment 92 is trained about a sheave 68 after which it leads back to a segment 94 which retroverts about the sheave 44 leading into the segment 96 that finally is guided about the sheave 70 to exit through an opening 98 in the proximal end from which it turns into an interior segment 100 that runs back to the bore in the proximal handle 24 where it joins the segment 30 to complete the loop.

With the looping configuration just described, there is an equal distribution of elongation on both sides of the band so that when the handles are pulled away from the housing, they will remain parallel to one another and to the ends of the housing and the housing will remain equidistant between the handles. This is a desirable arrangement and configuration because it is aesthetically attractive and will give a balanced distribution of stress to the user's body and limbs.

Due to the back and forth looping of the resiliently extensible means within the housing, the length of said means between matching ends of the housing, when the apparatus is idle, is several times the distance between the handles in their idle position whereby a greater length of said means is available for stretching than would be available if said handles were directly connected by said means without such looping. Moreover, because the looped portions of the resiliently extensible means are under low tension in idle condition of the apparatus, said portions cannot become entangled.

Different internal arrangements of the resiliently extensible means fall within the ambit of the invention, but are not considered desirable and will be mentioned only in passing. For example, in the form of the invention described, there are two retroversions of the resiliently extensible means at each end of the housing for each half of the band or four retroversions in all. A greater amplification can be obtained by using a larger number of retroversions, for example, three at each end of the housing for each half and a lesser amplification by using a lesser number of retroversions, for example, one at each end of the housing for each half. Also, if desired, a number of retroversions in the two halves of the band may be dissimilar. Thus, there can be two retroversions at one end of the housing for one half of the band and one at the other end for the other half, but this will result in an asymmetric amplification for the band halves and an ensuing dissymmetry in the displacement and positions of the handles and of the housing which usually will be undesirable, but which under some circumstances may be considered useful.

Also, instead of having the band continuous, as illustrated, i.e. a single band for the two handles, two bands may be employed, each band running from one end of one handle through a series of loops internally of the housing to an end of the handle at the opposite side of the housing and the other band being similarly arranged for the other ends of the handles. Likewise, three or more bands may be employed with the ends of the bands connected to spaced points on the handles and with interim portions of the bands, likewise, looped internally of the housing. In addition, one of the handles may be connected to the housing by a non-looped band or other means, e.g. an unyielding connection and the other handle connected to the housing by a resiliently extensible band which is looped within the housing and having its other end either anchored in the housing or anchored to the same handle as the first named end. This type of arrangement, likewise, is not a favored one because it provides a nonsymmetrical type of exerciser.

To assist in preventing entanglement of the resiliently extensible means within the housing, a longitudinally extending centrally disposed rib 102 may be provided which extends downwardly from the upper wall of the top half and lies between the sets of loops for the two halves of the resiliently extensible means which are provided about the various sheaves.

The length of the resiliently extensible means is such that in idle position of said means, the handles are pulled in to lie within the niches 26 and said means then is under a slight degree of tension, for example, in the order of about five pounds, e.g. is required to pull the handles apart. This figure is given purely by way of example and is not to be considered a limitation upon the invention.

The dimensions of the exercising apparatus are of considerable importance inasmuch as said apparatus is intended to be useful for people in every day sedentary occupations, not necessarily in physically active occupations as, for example, to be used by bankers, lawyers, doctors, stenographers, clerks, nurses, etc. It is desired to provide for these people a very simple, compact, inexpensive, light-weight piece of equipment, which will withstand hard use and is so compact that it can be carried about readily and inconspicuously. Accordingly, the dimensions and configuration of the apparatus is quite important. It already has been pointed out that the apparatus is roughly rectangular in shape and is generally elongated. It should be not much wider than a normal adult's chest for convenient modes of exercise, which will be described later, and wide enough for a person to stand upon with two feet. It also should be sturdy enough for a reasonably heavy adult to stand upon. With these thoughts in mind, and as pointed out previously, the housing is formed from a strong rigid plastic such as an ABS plastic having a thickness in the order of approximately $\frac{1}{4}''$. Its length, from end-to-end, should not exceed about 14" and its width should be about 6". Its height, i.e. its dimension from the outside of its top half to the underside of its bottom half, should be about 1". The handles should be approximately $\frac{1}{2}''$ in diameter or thereabouts and should be about 4" long. The lengths of the handles may vary somewhat, they obviously should not exceed the width of the housing. The niches should not detract too greatly from the length of the housing inasmuch as the length must provide enough room for a person to stand upon comfortably while performing certain exercises. The back of the housing can be somewhat wider because the niches do not present themselves to this dimension.

Attention has previously been drawn to the external dimensions of the housing, these being chosen for the sundry reasons as noted, namely to assist in the use of the exercising apparatus in the performance of calisthenics, but there is an important secondary reason, namely to permit the apparatus to be receivable in carrying cases such as commonly are used by "whitecollar" workers such for instance as teachers, lawyers, engineers, the medical profession, clerks, secretaries, sales people, etc., who, as a matter of routine, frequently carry cases to work such as attache cases, tote bags, accounting cases, and the like, which are generally of a rather small size, but seldom being smaller than about $13'' \times 17'' \times 3''$. It is for this reason that the critical external dimensions of the housing should not exceed about $11'' \times 16'' \times 1''$. Furthermore, since the weight of the exercising apparatus is quite low, e.g. is in the neighborhood of not more than about five pounds, it can be easily stuffed into a carrying case along with other items and does not represent too great a burden for a person to take along.

Despite its small size, general compactness and lightness of weight, the exercising apparatus is, nevertheless, quite effective for the performance of calisthenics. The initial force required to move the handles apart from their idle position is reasonably small, e.g. about five pounds, although it may be as low as three pounds. Yet, when the handles are stretched apart, to the fullest extent capable by an adult, a distance of approximately five feet, the tension exerted between the two handles by the resiliently extensible means is in the order of about twenty-five pounds. Hence, an adult exercising by stretching the two handles apart to the fullest extent possible, with two hands, will perform a reasonable, but not overly strenuous exercise.

The exercising apparatus lends itself to the performance of several modes of calisthenics, a few of which now will be mentioned and are illustrated in the accompanying figures. One simple mode of exercise is illustrated in FIG. 1. In this mode, the exercising apparatus is held with the hands grasping the two handles and the arms outstretched forwardly and parallel to one another and to the ground and with the legs slightly spread apart. This position is shown in full lines in FIG. 1 and now the person swings both arms toward the side so that they are outstretched laterally to their fullest extent. This will result in stretching of the resiliently extensible means. The entire said means will be placed under tension. Portions of said means will leave the housing 12 and the portions of the band remaining within the housing will ride around and be guided by the sundry sheaves stretching as they do so until an ultimate force of approximately twenty-five pounds is exerted by the resiliently extensible means.

Another exercise is to place either the bottom or the top broad surface of the housing in front of the user resting on the user's pectorals with the user's hands gripping the handles in idle position. Then, the user stretches one arm either forwardly or sideways and returns to idle position. After several repetitions, the exercise is carried out with the other arm and then with both arms together and alternately.

Another modification of the exercise, is to let the arms hang downwardly and have the exercising apparatus 10 flat against the user's groin and then extend either arm or both arms to a laterally outstretched position.

Figure 5:
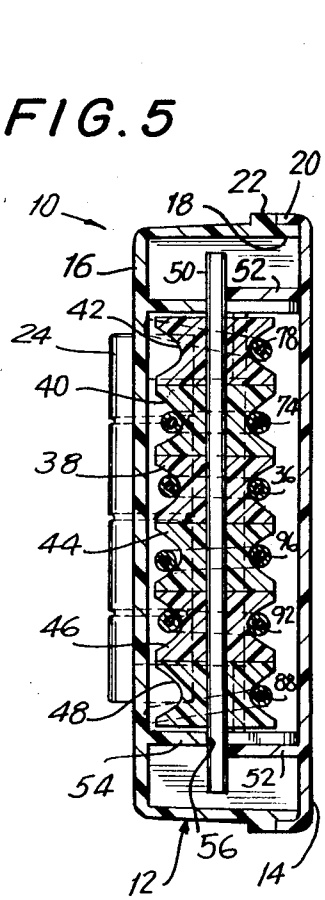
FIG. 5 is a sectional view taken substantially along the line 5—5 of FIG. 4.
Figure 2:
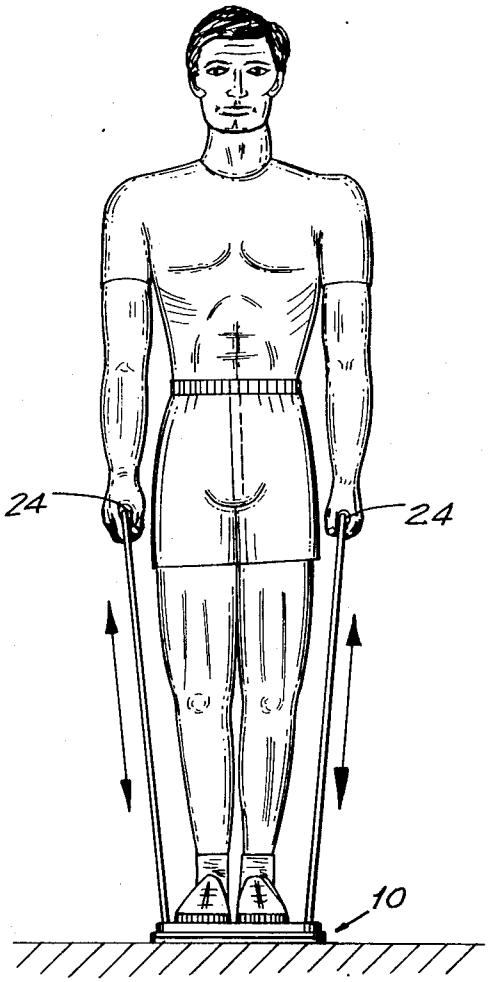
FIG. 2 is a view similar to FIG. 1, but showing an alternate exercising mode in which the exercising apparatus has its casing resting on the floor, with the exerciser standing thereon and holding the two handles in his hands, but pulled up from the exercising casing; the exerciser now can raise his arms to side outstretched position or do deep knee bends or raise his arms over his head, or with his arms outstretched perform seesaw motions with his arms.

A different form of exercise is illustrated in FIG. 2, where the housing 12 is placed on the floor or any flat horizontal surface and the user steps upon it with the handles on the outer sides of the user's feet. The user then stoops and grasps both handles and thereupon stands erect and repeats this exercise or touches his toes while holding on to the handles and then stands erect or can, from the position shown in FIG. 2, raise his arms outwardly to horizontally outstretched position and do this with one or both arms in a see-saw type of action. The exercising apparatus also can be used as a pseudo-rowing machine by placing the housing on a floor and sitting on it then, lying back, grasping the handles and performing a rowing motion with the hands.

Many other forms of calisthenics can be carried out with the apparatus 10, but the foregoing should suffice to illustrate its great versatility.

It will be understood that each of the elements described above, or two or more together, also may find a useful application in other types of constructions differing from the types described above.

While the invention has been illustrated and described as embodied in a compact portable exercising apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A compact portable exercising apparatus, comprising:

(a) a housing elongated along a longitudinal axis and having opposite end regions;

(b) retroverting means mounted within the housing and including a first plurality of pulleys at one end region of the housing and mounted for joint rotation about, and axially arranged in side-by-side relationship along, a first pulley axis which extends generally normal to the longitudinal axis, and a second plurality of pulleys at the other end region of the housing and mounted for joint rotation about, and axially arranged in side-by-side relationship along, a second pulley axis which extends generally normal to the longitudinal axis, said first and second pulley axes being in mutual parallelism and spaced apart by a predetermined distance along the longitudinal axis;

(c) a pair of handles located exteriorly of the housing and having handle passages extending through the handles; and (d) an elongated resiliently extensible endless rope having external rope portions extending through the handle passages and internal rope portions looped back and forth between the first and second pluralities of pulleys generally along the longitudinal axis, said endless rope being stretchable between (i) an idle position in which the rope is under low tension and urges the handles into mutual parallelism at the end regions of the housing, and (ii) a use position in which the rope is under high tension and resists an exerciser from moving the handles apart from each other over a distance greater than said predetermined distance.

2. The apparatus as recited in claim 1, wherein the housing has planar top and bottom walls spaced apart from each other in mutual parallelism, said top wall having at each of said end regions of the housing a first wall section extending generally perpendicularly of the plane of the top wall toward the bottom wall, and a second wall section extending generally parallel to the plane of the top wall, each first and second wall section extending transversely over at least part of each end region and together bounding a niche in which a respective handle is entirely received in the idle position.

3. The apparatus as recited in claim 1, wherein the housing has entrance and exit holes through which the rope passes, said holes being formed at each end region within each niche.

4. The apparatus as recited in claim 1, wherein each plurality of pulleys includes two colinear pairs of three pulleys, each pair constituting a sub-set; and wherein a first sub-set of the first plurality is juxtaposed with a first sub-set of the second plurality; and wherein the internal loop portions include a first loop entrained about the first sub-sets of each plurality; and wherein a second sub-set of the first plurality is juxtaposed with a second sub-set of the second plurality; and wherein the internal loop portions include a second loop entrained about the second sub-sets of each plurality; and further comprising a rib extending between the first and second loops for preventing the former and the latter from entangling with each other during stretching.

5. The apparatus as recited in claim 1, wherein the housing has a generally parallelepiped shape whose external dimensions are less than 16 inches in length, 11 inches in width and one inch in depth.

* * * * *